US007553205B2

(12) United States Patent
LoSchiavo et al.

(10) Patent No.: US 7,553,205 B2
(45) Date of Patent: Jun. 30, 2009

(54) ELECTROMECHANICAL SPRING-POWERED ACTUATOR

(75) Inventors: Martin J. LoSchiavo, Rocky Hill, CT (US); Anthony G. Viggiano, Groton, CT (US)

(73) Assignee: Autotether, Inc., Chester, CT (US)

( * ) Notice: Subject to any disclaimer, the term of this patent is extended or adjusted under 35 U.S.C. 154(b) by 247 days.

(21) Appl. No.: 11/786,205

(22) Filed: Apr. 10, 2007

(65) Prior Publication Data

US 2007/0270051 A1 Nov. 22, 2007

Related U.S. Application Data

(63) Continuation-in-part of application No. 11/290,727, filed on Nov. 30, 2005, now Pat. No. 7,201,619.

(51) Int. Cl.
*B63H 21/22* (2006.01)

(52) U.S. Cl. ..... 440/1; 74/2

(58) Field of Classification Search ..... 440/1, 440/2, 84; 74/2; 89/1.51
See application file for complete search history.

(56) References Cited

U.S. PATENT DOCUMENTS 3,730,005 A * 5/1973 Hjermstad et al. ..... 74/2
4,557,177 A * 12/1985 Cheney ..... 89/1.51
4,563,908 A * 1/1986 Shube ..... 74/2
4,891,994 A * 1/1990 Barba ..... 74/2
7,201,619 B1 * 4/2007 Viggiano et al. ..... 440/1
7,448,925 B2 * 11/2008 Viggiano et al. ..... 440/1

OTHER PUBLICATIONS

U.S. Appl. No. 11/768,211, filed Apr. 10, 2007, A. Viggiano et al., "Safety Shut-Off Device of Vehicle Having Rotary Ignition Switch."
U.S. Appl. No. 11/768,205, filed Apr. 10, 2007, LoSchiavo et al., for "Electromechanical Spring Powered Actuator."
U.S. Appl. No. 11/768,199, filed Apr. 10, 2007, Viggiano et al., for "Sailboat Safety System For Person Falling Overboard."

* cited by examiner

*Primary Examiner*—Lars A Olson
(74) *Attorney, Agent, or Firm*—C. Nessler

(57) ABSTRACT

An actuator, which find exemplary use in connection with a safety system which aims to stop powering of a boat by an engine or sail if a person falls overboard. The actuator stores energy in a main spring which is manually created by pushing linearly on an actuator rod which extends from the actuator housing. The main spring is captured between two concentric sleeves one of which sleeves is fixed to the housing. A low power coil is energizes a magnetic shuttle to cause linear motion of a shuttle against urging of small spring contained within the bore of the shuttle. Movement of the shuttle enables radial motion of balls from a position where the sleeves are locked together to one which enables one sleeve to move under force of the main spring, and thereby move the push/pull rod and act on an object to which the actuator is connected.

17 Claims, 7 Drawing Sheets

ELECTROMECHANICAL SPRING-POWERED ACTUATOR

This application is a continuation in part of patent application Ser. No. 11/290,727, filed Nov. 30, 2005, now Pat. No. 7,201,619 of A. Viggiano and M. LoSchiavo.

TECHNICAL FIELD

The present invention relates to electromechanical devices for providing mechanical actuation, where the device includes spring for energy storage and release during actuation.

BACKGROUND

The present invention is described in terms of its application to solving a problem which arises in protecting the operator of a small motor boat, sail boat or other vehicle, if the person falls overboard into the water and the boat continues to run on its course, leaving the operator alone in the water and in jeopardy, especially when the boat is distant from land or other boats. The parent patent application Ser. No. 11/290,727 "Safety Shut Off System for a Powered Vehicle", filed Nov. 30, 2005 by A. Viggiano and M. LoSchiavo, now Pat. No. 7,201,619 describes in more detail the problem, prior attempts to solve the problem, and a new means for solving the problem. The Background, Brief Description of Drawings, Description, and Drawings of said patent application are hereby incorporated by reference into the description which follows here.

Briefly, the parent application describes a system which provides an improved way of killing the engine of a watercraft, when the operator or another occupant falls overboard or otherwise moves away. An object of the related application is to provide a means for replacing the lanyard with a wireless device, which can be retrofitted onto a watercraft having a familiar lanyard-actuated kill switch, without need for intervention into the craft wiring system. In another aspect of the invention, a separable member holds the sail is place and it is released. In some preferred embodiments that is accomplished by means of a linear-acting actuator. This application is concerned with the electromechanical actuator. A problem presented insofar as the actuator is concerned for the safety system is that the actuator must generate a substantial amount of force or power must be generated to remove a latch key, which by intention is resistive to casual light foce removal. The device must be compact and lightweight, adapted for mounting by a layman on an instrument panel of a boat, or in proximity to a sail. The device must be reliable in the moist environment which is associated with boats. The device ought not consume large amounts of electrical energy.

SUMMARY

An object of the invention is to provide an electromechanical actuator which is compact and consumes low amounts of electric energy. An object of the invention is to provide a way of storing energy in a spring and releasing it in response to a relative small electrical input or mechanical input to thereby provide substantially greater instantaneous mechanical force than the same about of electric energy would generate by itself, absent the energy storing An actuator of the invention has an exemplary use in connection with a safety system which aims to stop the engine of a boat when a person falls overboard, and a latch key is pushed or pulled from a spring loaded kill switch of the boat engine. See the Description for the other elements of the system which incorporates the actuator of the invention. In accord with the invention, a linear actuator stores energy in a main spring which is compressed between internal slidable sleeves.

In an embodiment of the invention, the energy is manually input by pushing or pulling on a plunger or a pull rod. A compact and low power solenoid type coil is energized to impart linear motion to a shuttle, which in the actuator rest state positions balls so that they hold concentric sleeves in fixed position against the action of the main spring. The shuttle is urged toward its rest state by a low energy and low force shuttle spring. Linear movement of the shuttle, induced by the coil against the action of the shuttle spring, enables the balls to move radially and releases the sleeves from self-engagement; and a plunger of the actuator moves linearly under action of one of the sleeves and force of the main spring.

An embodiment of actuator invention comprises at least two sleeves which are slidable lengthwise relative to each other, wherein a multiplicity of balls are positioned within, and radially movable within, holes in one of the sleeves. The motion of at least one sleeve relative the another sleeve or to another part of the actuator is a function of whether or not the balls have a particular radial position. The first sleeve is circumscribed by the bore of the second sleeve.

An embodiment of the actuator like the foregoing has a first sleeve which is fixed and a second sleeve which is slidable lengthwise while contacting both the second sleeve exterior and the interior of an actuator housing. A main spring is positioned inside the second sleeve, to create separation force between the sleeves. When the second sleeve moves, its motion is imparted to a rod which extends through the actuator housing, which rod is either a push rod or a pull rod. A shuttle is slidable within the interior of the second sleeve, and urges the balls to move radially when sliding from one position to another position. Preferably the shuttle is moved electromagnetically and has a lengthwise bore cavity at one end, for receiving a shuttle spring, the urging force of which opposes the direction in which the electromagnetic force is exerted.

Since the acutator stores manually input mechanical energy in the spring, the electrical power needed is only that which is sufficient to move the small shuttle and enable release of the spring force and energy, thus achieving several objects of the invention.

The foregoing and other objects, features and advantages of the present invention will become more apparent from the following description of preferred embodiments and accompanying drawings.

DESCRIPTION

Figure 1:
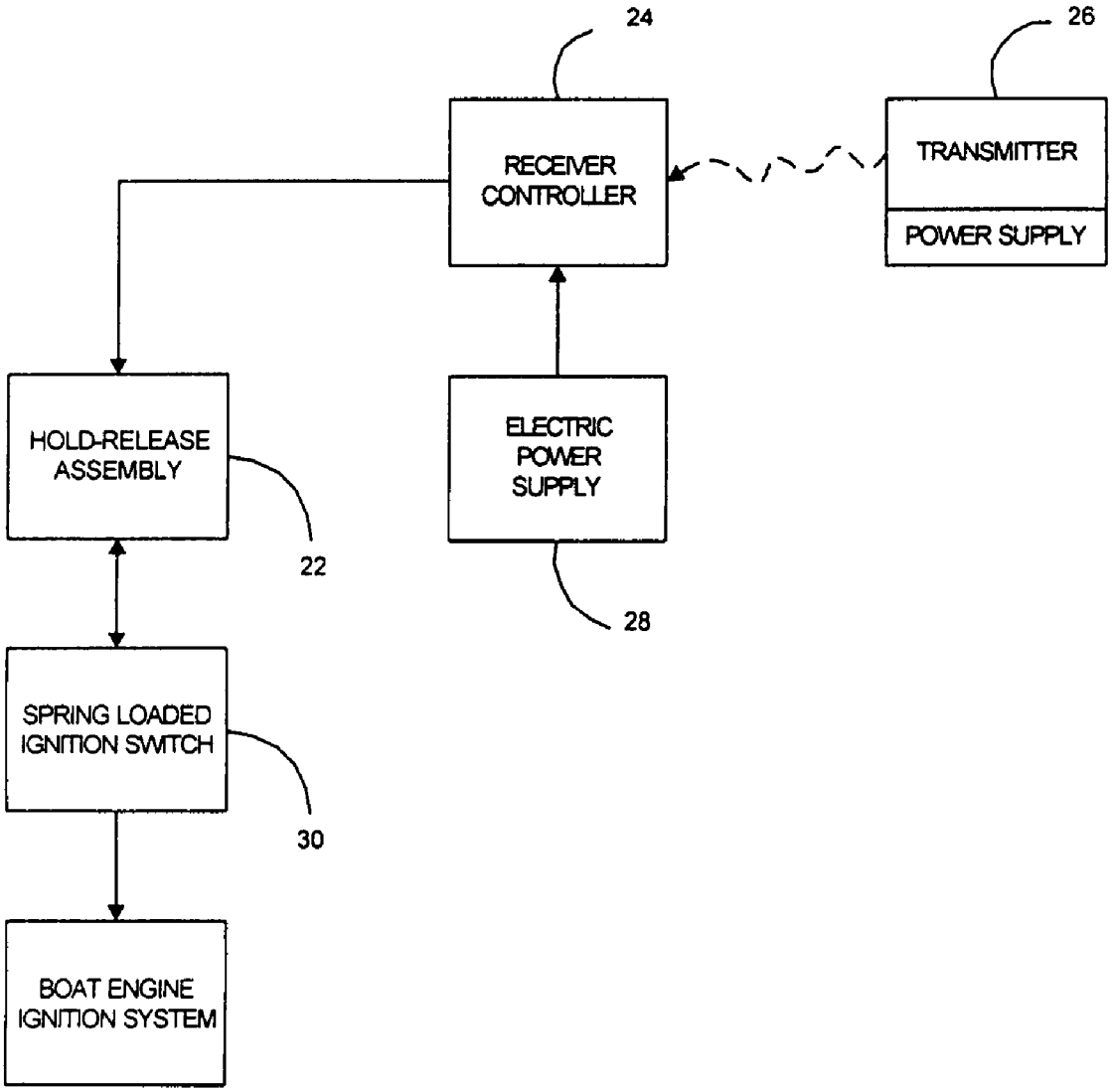
FIG. 1 is a diagram showing the major components an embodiment of the invention system.

The actuator invention is described in terms of its use with a particular boat safety system which is comprised of several essential components, the relationship of which is shown in block form in FIG. 1. Transmitter 26, having a self-contained battery power supply is carried by the operator or other person on a boat. It is in wireless radio communication with a receiver-controller 24, that has its own power supply 28, which may be that of the boat. The receiver-controller is in electromagnetic communication with the hold-release assembly (HRA) 60, as by wires or radio or light waves. The HRA 60 is physically connected to the boat kill switch, which has a built-in spring loaded "kill" mechanism. Such type of kill switch is well known commercially, for use with internal combustion engines on boats. See Taskahsima U.S. Pat. No. 6,352,045.

Figure 2:
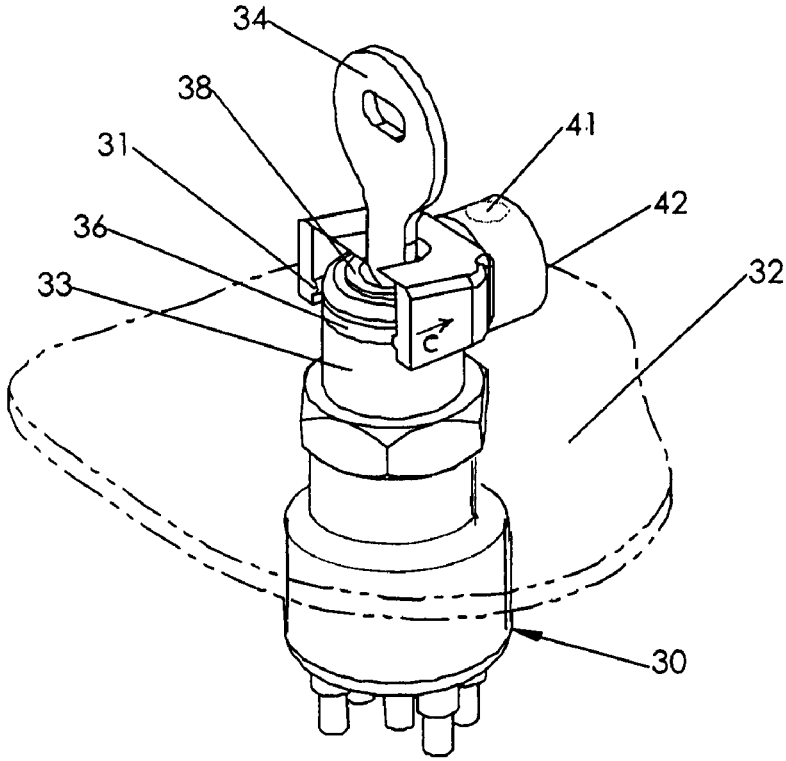
FIG. 2 is an isometric view showing a kill switch having a turn-key and an attached latch key and a portion of instrument panel in phantom.

FIG. 2 is an isometric view of a common kill switch 30 is shown as it mounts in a boat instrument panel 32, shown in phantom. A latch key 40 (also called a clip or simply a key), preferably made of thermoplastic, is engaged with switch 30 in the same manner as is familiar for lanyard-type latch keys used in the prior art. The means for connection of a lanyard to the kill switch is suggested in FIG. 2 by phantom hole 41. A feature of the invention is that it is suitable for retrofit to water craft having a variety of prior art kill switches. A further feature of the invention is a boat operator can use it in conjunction with an old-style lanyard running to his or her person, so either the lanyard or actuator causes the kill switch to stop the engine.

The internal combustion engine ignition system of a boat having kill switch 30 is turned on and off by rotation of common serrated key 34 inserted into switch 30. By design of the switch, to enable the engine to run it is also necessary that the plunger 38, the center part of the switch, be continuously depressed. To enable that, a boat operator slides latch key 40 into place around the switch, as it is shown in FIG. 2. The latch key has opposing side lips 31 within its interior cavity, which the operator engages with groove 36 of the switch body 33. In doing this, the operator necessarily depresses plunger 38; and, when in place, the top of the latch key keeps it from springing upwardly. When, afterwards, sufficient lateral force and energy is applied to the latch key, as indicated by arrow C in FIG. 2, plunger 38 springs upwardly, shutting off the boat engine. In the invention, that lateral force is provided by the actuator 50.

The upward spring force of the plunger 38 on the latch key causes friction force at the groove. By design, friction force is also created by outward expansion of the opposing sides of the latch key, in the circumferential plane of the groove. The combined frictional forces are intended to keep the latch key in place under light lateral forces, which is especially important in the lanyard type prior art system. In an embodiment of the present invention, the latch key and actuator form an assembly 60 which is supported off the switch, thus also necessitating good frictional engagement. The frictional forces are sufficient to keep the latch key engaged with the switch body in the presence of normal shaking and bumping of a boat. It may take from 5 to 8 pounds of lateral force to pull the latch key away from the switch. But as may be appreciated, that means the actuator needs to apply commensurate force to disengage the latch key. Brute force, in terms of an electric solenoid actuator may be employed, but at the penalty of weight and high electric power demand. Preferably, as described in detail below, energy is stored in the actuator by manual compression of a spring. When a person falls overboard, energizing of a small electric coil in the actuator releases the spring energy, thus providing the sufficient energy and force to pull the latch off the switch.

Figure 3:
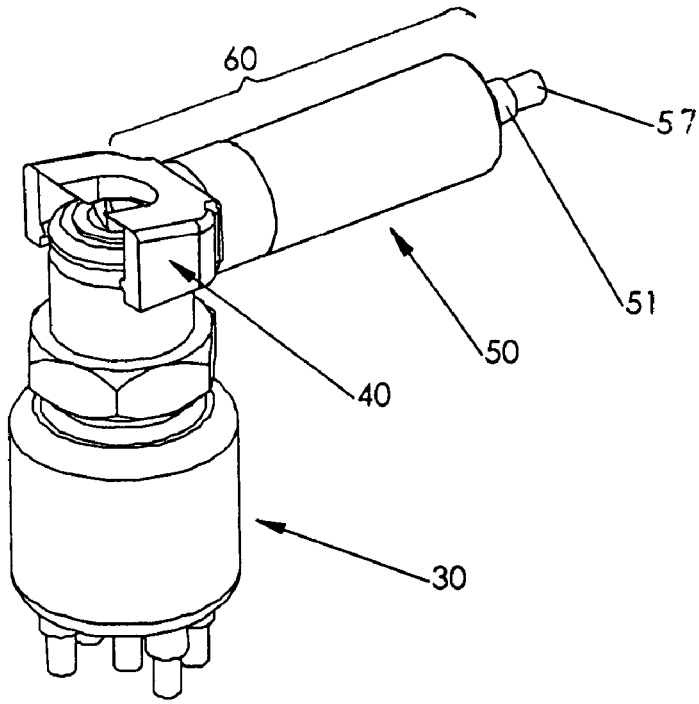
FIG. 3 is a different isometric view of the kill switch of FIG. 2, on which is mounted hold-release assembly (HRA) comprised of a latch key fastened to an actuator.
Figure 4:
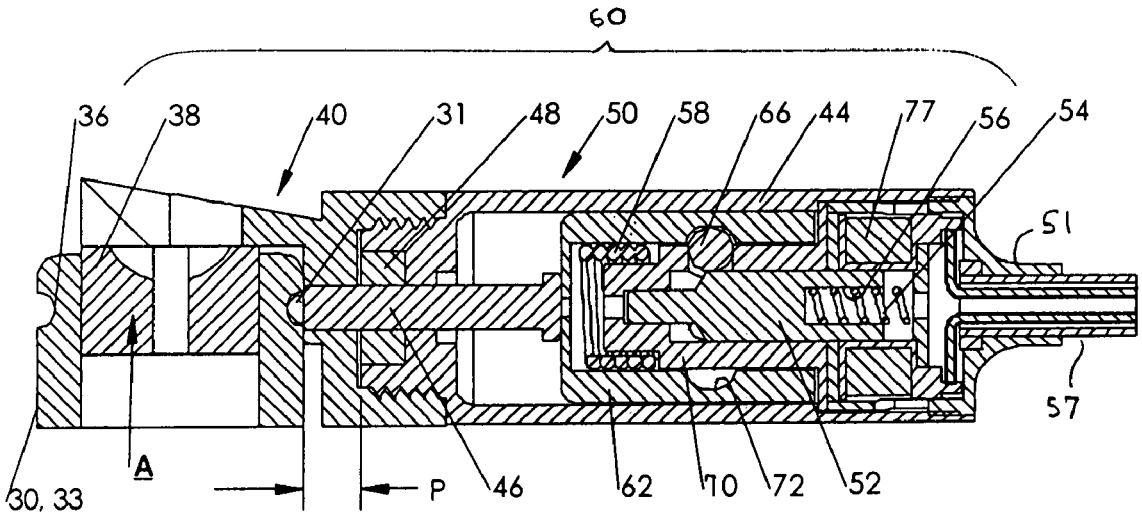
FIG. 4 is a longitudinal plane cross section of the hold-release assembly HRA of FIG. 3, and a portion of the kill switch, showing the actuator in un-energized condition.
Figure 5:
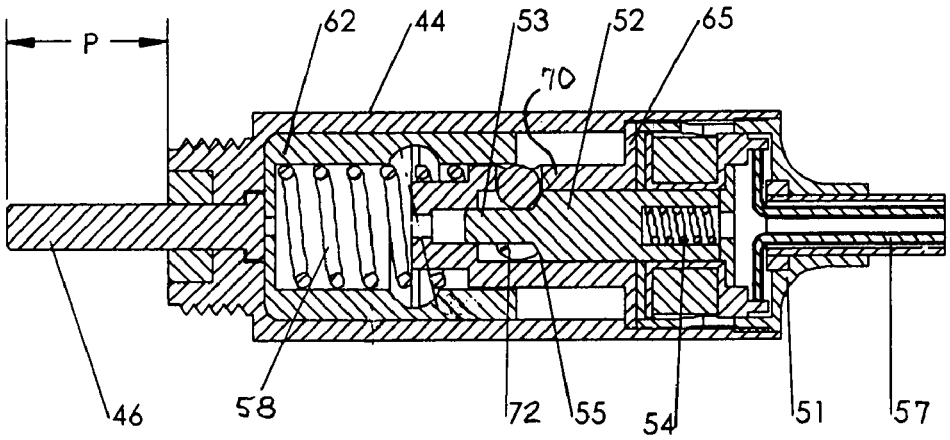
FIG. 5 is a view mostly like FIG. 4, showing the hold-release assembly HRA after the coil has been energized to extend the push rod and discharge the assembly from engagement with the switch. The view also shows and optional end cap which protects wires running to the coil.

In the embodiment of FIG. 3-5, latch key 40 is fastened to actuator 50, preferably by threads as shown, to form an integral Hold-Release Assembly (HRA)60. When the latch key is engaged with the switch, assembly 60 has holds the switch plunger depressed in place. When the signal received at the receiver at the boat diminishes below a pre-determined threshold, the latch key is pulled off the switch by actuator. A push rod of the actuator pushes against the side of the switch body, and the actuator is forced away from the switch, laterally pulling the attached latch key off the switch. If needed, the HRA can be attached to the instrument panel by a flexible cord to prevent it from falling away as it is disengaged from the switch. The latch key 40 can have different shapes from that illustrated here, as taught by the prior art. For example, some prior art kill switches have a plunger which must be held in raised position. The invention may also be applied to a kill switch which has a rotary, rather than up and down, "kill element" action; and to a kill switch which acts as does a toggle switch.

FIG. 4 is a longitudinal cross section of HRA assembly 60, showing in more detail how it engages kill switch 30. Latch key 40 is threaded onto outer housing 44 which is preferably made of thermoplastic. Other means of fastening, e.g., set screws, may be used. FIG. 4 shows the position of HRA components when sufficient radio signal from the transmitter is being received, i.e., when things are normal and the operator is in the boat. The actuator is said to be in its spring energized condition. In that condition, HRA 60 cantilevers in space from its mounting on the kill switch by means of the latch key engagement; and, plunger 38 is depressed. Arrow A shows the spring bias of the plunger and capability for vertical motion.

FIG. 5 is like FIG. 4 but shows the actuator 50 in its de-energized condition. This is the condition when the signal to the receiver has diminished or ceased, e.g., when someone has fallen overboard. The FIG. 4 view omits switch 30. A desirable end cap 51 screws onto the outside of housing 44 and protects wires 57 which run to the electromagnetic coil 77 at the right end of the actuator. Actuator 50 is connected by wires 57 or other electromagnetic power transmitting means to the receiver-controller.

Referring to both FIG. 4 and FIG. 5, a movable element, namely push rod 46, protrudes from a seal, preferably a lip seal 48, at the end of the actuator which attaches to the latch key. When HRA 60 is mounted on a switch, push rod 46 contacts or is in close proximity to the side of switch. See FIG. 4. When, as a consequence of diminution of radio signal strength received by the receiver-controller assembly 24, the coil 77 becomes energized, thus causing release of stored energy in main spring 58 which makes the push rod 46 move outwardly so that the plunger extension P increases. The extension P is sufficient to cause the latch key to withdraw from engagement with groove 36 of the switch. The whole HRA 60 moves to the right, and will fall away by momentum and gravity from vicinity of the switch. As desired, some restraint like a bracket or line may be used to keep it nearby.

When the latch key is removed from the switch, switch plunger 38 moves upwardly, thereby cutting the engine ignition system.

To reinstall HRA 60 on the switch, push rod 46 is manually pressed inwardly to the position shown in FIG. 4. As described below, when that is done and HRA has been de-energized, the push rod stays pressed-in. The latch key lips 31 are slid back into the groove 36 of switch 30, while the switch center part 38 is manually depressed, as described above. The actuator provides sufficient force to pull the latch key from the switch, of the order of 5 to 8 pounds force. The actuator has unique construction to provide sufficient energy and force, but at the same time be compact and light, and economic to manufacture. This construction will now be described. Reference is again made to FIGS. 4 and 5.

In the FIG. 4 there is no power to electromagnetic coil 77 and the HRA is mounted on the kill switch. Shuttle 52 lies within the coil 77. It is made of electroplated magnetic steel. Shuttle spring 54 is of the compressive type. It is positioned within cavity 56 at the right end of shuttle 52. Coaxial sleeves 62, 70 circumscribe the shuttle 52. Fixed inner sleeve 70 has three circumferentially-spaced apart radial holes 72, within which are loosely held three latch key balls 66. Shuttle 52 moves lengthwise within the bore of inner sleeve 70. Inner sleeve 70 moves lengthwise within the bore of outer sleeve 62. In use, balls 66 alternately move radially out and in, as described below, to thereby alternately lock and release the sleeves 62, 70 from engagement with each other, by moving into or out of circumferential groove 72.

Inner sleeve 70 is made of non-magnetic material, such as Delrin thermoplastic or stainless steel. It is fixed in position by engagement of flange 65 with the bore of Nylon housing 44. Outer sleeve 62 is made of 300 series stainless steel. When outer sleeve 62 moves lengthwise (to the left in the FIG. 4), the closed end of sleeve 62 pushes on stainless steel push rod 46, increasing its extension from the actuator housing. Conversely, when push rod 46 is pressed inwardly, it moves sleeve 62 to the right toward its home position where it stays, provided the actuator and coil are de-energized. Manually pushing the push rod in compresses main spring 58, which is captured between the outer and inner sleeves so it urges them to separate. The drawings show various axial holes along the central axis which allow escape or entry of air, so captured air or vacuum does not impede the linear motions of the parts.

In operation of the actuator, coil 77 is energized as a result of a change in radio signal from the transmitter worn by a person who has fallen overboard or who has otherwise left vicinity of the receiver controller. When the coil is energized, shuttle 52 is magnetically moved into the coil 77 (to the right in the FIG. 4), thus compressing shuttle spring 54 and storing energy therein. The left end of shuttle 52 has a tapered shoulder 55 running to a smaller diameter end 53. The spring force on sleeve 62 is applied to the balls 66, urging them radially inwardly. Thus, when the smaller diameter portion of shuttle 52 moves and presents itself at the transverse plane location of the balls, they do move inwardly. That frees outer sleeve 62 from engagement with inner sleeve 70. That enables outer sleeve 62 to move away from the coil (to the left in FIG. 4). The motion of sleeve 70 causes push rod 46 to extend, and thus HRA 60 is ejected from the kill switch. The disposition of the internal parts of the actuator after these actions have taken place is shown in FIG. 5.

After the push rod has extended, electric power to the coil will be terminated by a control circuit timer in the controller. However, when the power to the coil is terminated, shuttle 52 does not move back to its home position, since it is restrained by balls 66 which are in contact with its shoulder 55. Nonetheless, the operator of the boat will now reset the actuator for another use. The operator manually depresses push rod 46. That compresses main spring 58 while moving outer sleeve 62 to the right, toward the coil. When the motion of sleeve 62 is sufficient, balls 66 will be thrust outwardly due to the force of shuttle spring 54, transmitted at shoulder 55 of the shuttle 52. Then, shuttle 52 moves in the opposite direction, with release of the stored energy in shuttle spring 54. The changed position of the shuttle prevents radially inward motion of the balls, and the outer sleeve 62 is again locked into its home position, characteristic of the de- energized state of the device. In a variation not shown, the push rod may rotate a cam which is in contact with the side of the switch body, for more amplification of mechanical force. Within the scope of the claimed invention, the term spring as used herein is intended to comprehend devices other than those made of spring-steel for storing energy, such as elastomers, gas compression cylinders (gas struts), and spring substitutes, such as linear actuators.

In the generality of the actuator construction and use, manual or mechanical energy of the operator is stored in the device, e.g., in the main spring by depressing the push rod to set the device. Release of that stored mechanical energy is prevented by an internal mechanical latch keying means, e.g., the balls. Electromechanical means, e.g., the coil and movement of the shuttle when the coil is energized (which movement is often referred to as "solenoid action"), releases the actuator internal locking mechanism, to enable release of the stored energy, which extends the push rod and ejects the HRA from the kill switch. In the generality of the invention, for applications other than the boat safety system, the coil can be omitted and the shuttle may be moved mechanically from its rest position to the position where the spring energy is released, for instance by a linear-moving rod or other member that pushes or pulls the shuttle lengthwise and extends lengthwise from the actuator housing.

In some commercial kill switches, the movable element is spring biased to cause the plunger to move inwardly, into the switch body, rather than outwardly, when the latch key is removed, to stop an engine. The invention will be useful with such devices by use of a suitable latch key, similar to that used when such devices are operated by means of a lanyard.

Figure 6:
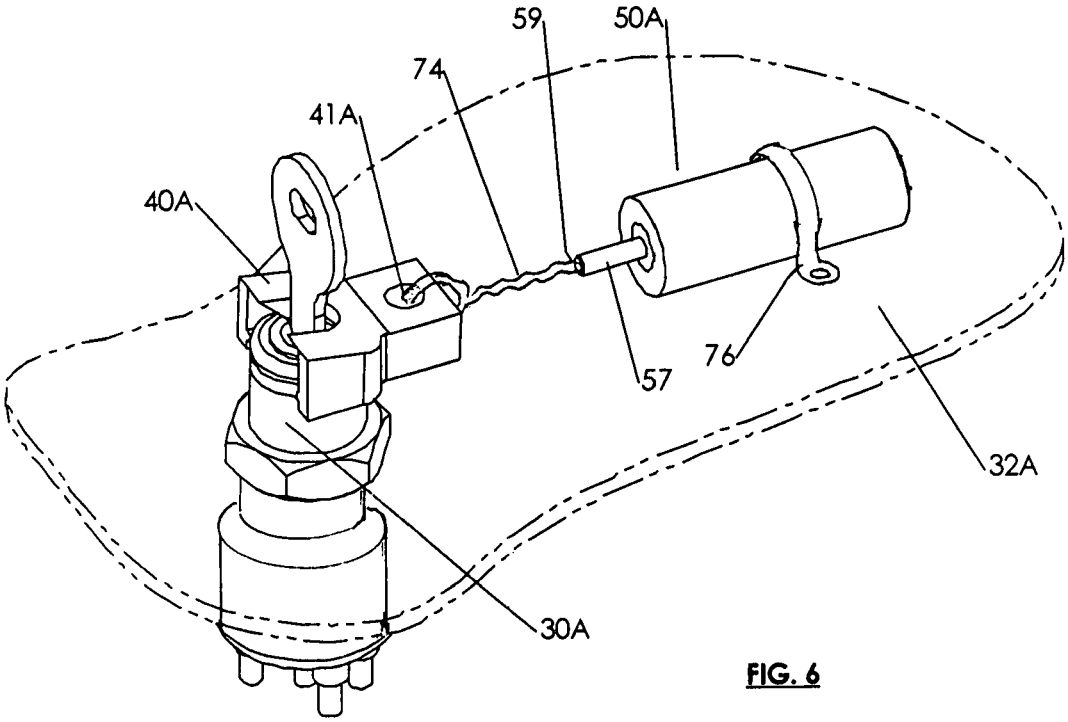
FIG. 6 is an isometric view of a hold-release assembly HRA wherein the spaced apart actuator is connected to the latch key by a tether.
Figure 7:
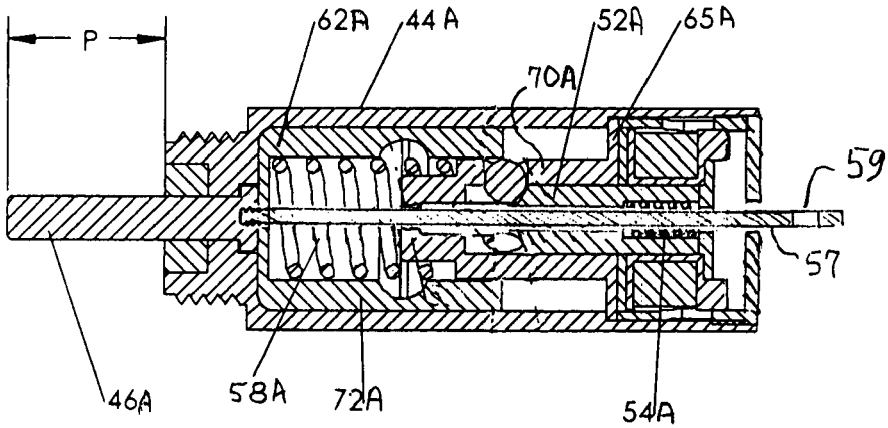
FIG. 7 shows an actuator having a push rod rather than a pull rod.

FIGS. 6 and 7 show an alternate embodiment of the invention in which the rod of the actuator pulls rather than pushes. Parts having numbers with suffixes in these and other Figures correspond with those previously described. The latch key 40A is mounted on the switch 30A as previously described. Actuator 50A is fastened by clamp 76 to the instrument panel or another surface of the boat in vicinity of the kill switch. Tether 74 runs between the pull rod 57 of actuator 50A and latch key 40A. When commanded to act, the actuator pulls on the tether, pulling the latch from the kill switch, to stop the engine FIG. 7 shows one way in which the actuator 50 of FIG. 4 and 5 can be modified to pull rather than push. FIG. 7 is an adaptation of FIG. 5, and shows the actuator when rod 57 has been pulled into the actuator. The power lines running to the coil are omitted. Pull rod 57 screws into the base of shuttle plunger 46A; and it extends through clearance bores in the various components including elements 70A and 52A. Hole 59 enables connection of tether 74 to rod 57. For this and other embodiments, variations in the mechanical construction of the actuator may be employed to achieve the same functional result. Commercially available solenoid type actuators may be utilized, although that could involve more complexity or larger size.

Figure 8:
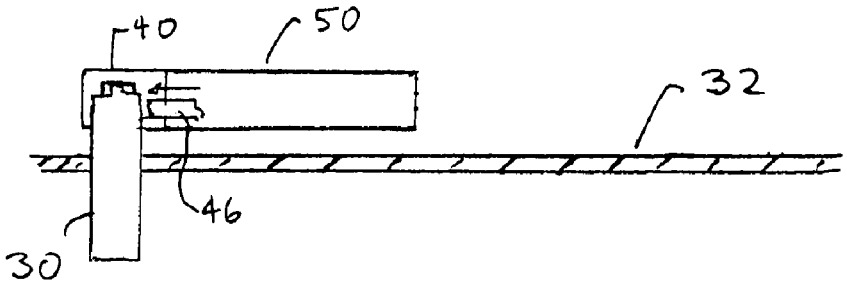
FIG. 8 is a semi-schematic view of essential parts of the invention system, showing a latch key fastened to the actuator, where the assembly is mounted on the switch, in accord with FIG. 3.
Figure 9:
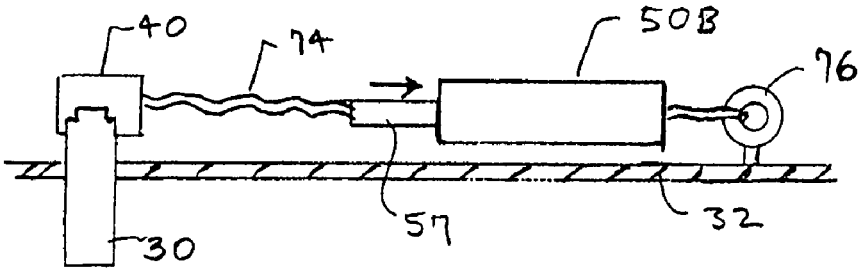
FIG. 9 is similar to FIG. 8, showing an actuator which is tether connected both to the craft and to the latch key which is on the kill switch.
Figure 10:
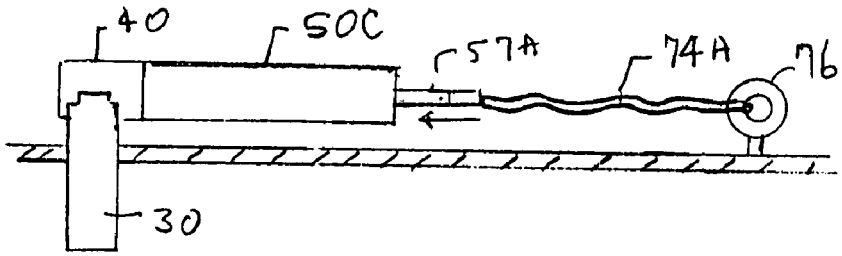
FIG. 10 is similar to FIG. 8, showing a latch key fastened to the actuator which is tether connected to the craft.

FIGS. 8, 9 and 10 semi-schematically show different embodiments of the invention. The motion of the rod of the actuator is indicated by an arrow. FIG. 8 corresponds with the invention described for FIGS. 3, 4 and 5. FIG. 9 corresponds with FIGS. 6 and 7, with the variation that an end of the actuator is connected to a second tether which runs from a ring attachment point 76, rather than having the actuator mounted on the instrument panel 32. FIG. 10 shows another variation, in which the actuator has a rod 57A which, when energized, retracts and pulls on tether 74A that runs to ring 76. The resultant tension force causes the latch key and actuator assembly (40 and 50C) to be pulled from the kill switch.

Figure 11:
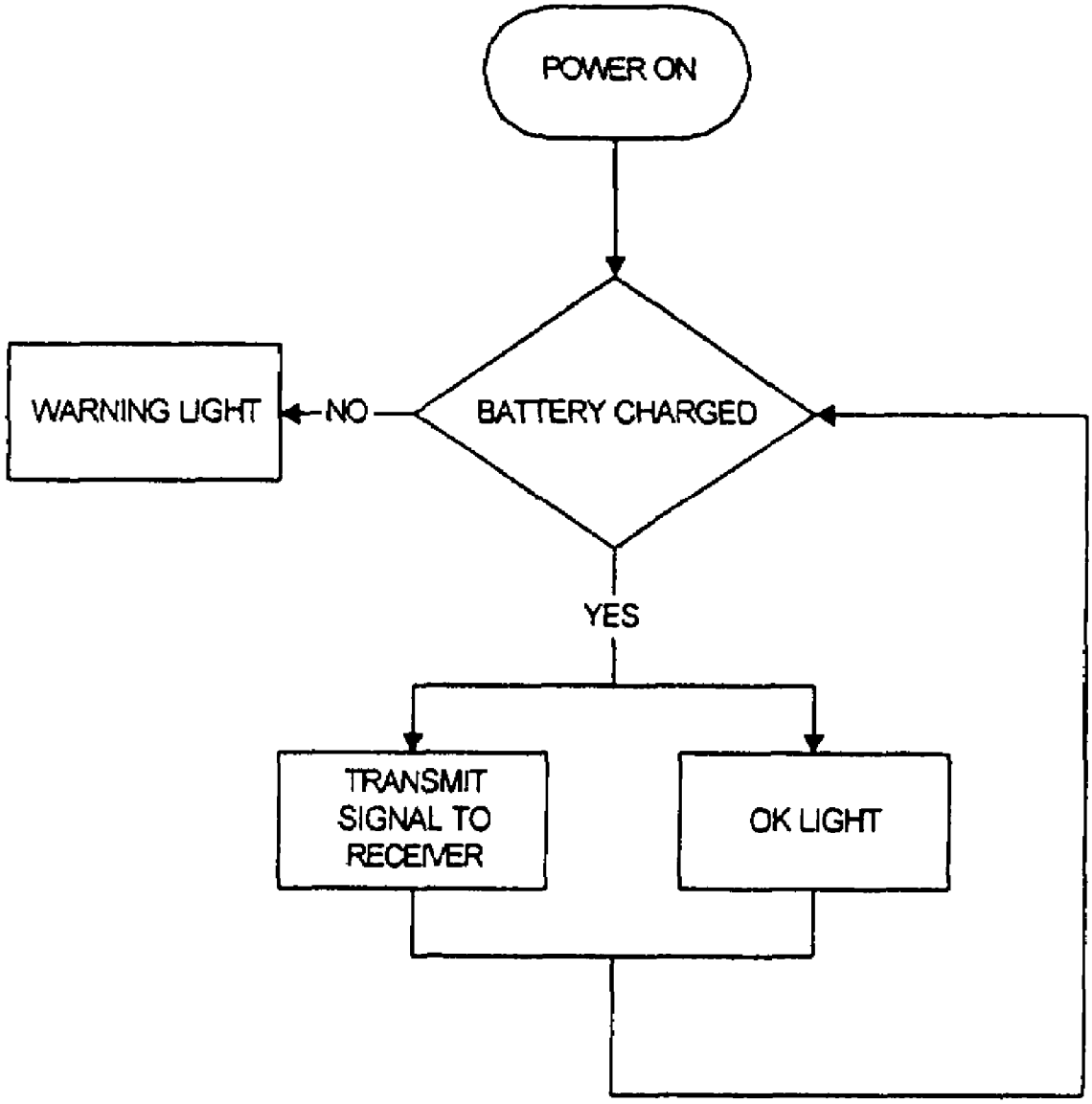
FIG. 11 is a function flow diagram for the receiver-controller and actuator which receives a signal from the transmitter
Figure 12:
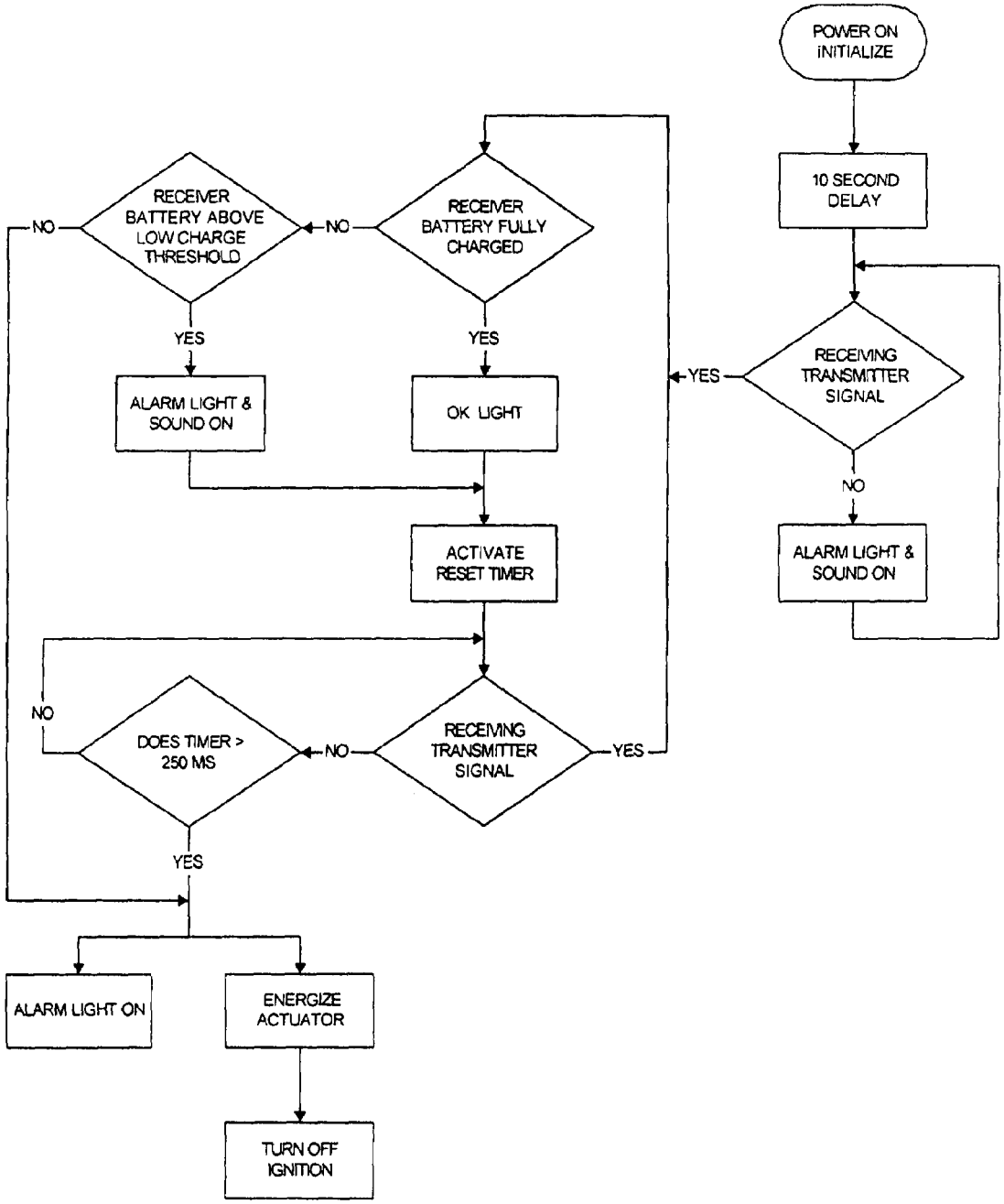
FIG. 12 is a function flow diagram for a transmitter which sends a signal to the receiver.

As mentioned, FIG. 1 shows the overall interconnectedness of the elements of the system of the present invention. FIG. 12 is a function flow chart for the receiver-controller 24 and FIG. 11 is a chart for the transmitter. The radio transmitter 24, worn by the operator or other boat occupant, and radio receiver-controller 26, mounted on the boat, are preferably comprised of commercially available elements. For example, the transmitter may send signals at 300-400 megahertz. They may be constructed along the lines indicated in patents of the Background.

FIG. 12 shows the functioning of receiver-controller 24, hereafter simply called "receiver." FIG. 11 shows the function of the transmitter 26. How the electrical components of the system function is described in detail in parent patent application Ser. No. 11/290,727, filed Nov. 30, 2005, now Pat. No. 7,201,619 incorporated here by reference, to the Description of which reference may be had.

The invention can be applied to kill switch designs other than that illustrated, by modification within the ordinary skill of artisans. For example, some kill switches comprise a central button which retracts into the body of the switch, when the latch key is withdrawn from the grooves of the button. For example, some switches have a tang which is engaged by a plastic loop; and when the loop is pulled away from the switch, the engine is killed. For instance, a non-magnetic shaft attached to the closed end of outer sleeve 62 could run through a lengthwise hole in shuttle 52, so it extends from the rear end of housing 44. While the actuator is preferably intimately physically attached to the latch key as has been described, in alternate embodiments the actuator may be spaced apart from the latch key and switch, to be connected by a lanyard.

While the invention enables continued manufacture and use of boats with the familiar lanyard type kill switches, the invention may carried out with new kill switches, especially configured for use with a wirelessly commanded actuator. Similarly, the invention may be applied to craft having diesel engines which do not require used of an ignition system, by actuating the means by which the engine is ordinarily stopped, such as by stopping fuel flow to the engine through an electrically controlled valve.

While the invention has been described in terms of water craft, it may be applied in similar fashion to land craft. For instance, it may be used with motorcycles, snowmobiles and the like, which are powered by internal combustion engines.

The invention offers advantages previously sought by other inventors, where separation of a I transmitter and receiver causes the killing of the engine. Moreover, the invention enables a boat which is in the field, or in a factory, to be fitted with a non-lanyard safety system without intervention into the electric system or use of any electrical craft skills.

The actuator of the present invention may be used for other purposes than the boat safety device application for which it was first developed and is described above. The linear push-or-pull output may be used to power other devices, including those which convert the linear motion and force into another type, for instance rotational motion.

Although this invention has been shown and described with respect to one or more preferred embodiments, and by examples, those should not be considered as limiting the claims, since it will be understood by those skilled in this art that various changes in form and detail thereof may be made without departing from the spirit and scope of the claimed invention.

We claim:

1. An electromechanical actuator comprising:

a housing having a lengthwise axis and a bore with a first end and a second end spaced apart along the axis;

a plunger, movable along the axis, for imparting linear force to an object external to the housing;

a first sleeve, fixedly engaged with the housing, extending lengthwise toward the second end of the housing, the outside diameter of the sleeve radially spaced apart inwardly from the bore of the housing, having a plurality of circumferentially spaced apart holes for receiving balls;

a second sleeve, mounted on the exterior of the first sleeve and slidable therealong, having a first end and second end corresponding with the ends of the housing, having structure at the second end for moving the plunger lengthwise along said axis toward said second end of the housing while sliding on the first sleeve, and having an interior circumferential groove for engaging portions of one or more balls positioned in the holes of the first sleeve;

a plurality of balls positioned within said plurality of holes of said first sleeve;

a main spring positioned within the interior of said second sleeve, for creating separation force between the first and second sleeves, and for thereby urging the second sleeve to move toward said second end of the housing;

a shuttle, slidable within the interior of the second sleeve, shaped as a stepped cylinder, having a first end and second end, the ends corresponding with said housing ends, the first end having a larger diameter than the second end; the shuttle having a tapered transition section between the first and second diameter portions; wherein, when said shuttle first end slides to proximity of said circumferential holes of the first sleeve, said balls within said holes are thrust outwardly, to thereby engage said circumferential groove of the second sleeve; the shuttle further having a bore cavity at the first end, for receiving a shuttle spring;

a shuttle spring, positioned within said bore cavity of the shuttle, for urging the shuttle lengthwise so that the shuttle second end contacts and urges outwardly said balls; and, an electromagnetic coil for imparting lengthwise motion to the shuttle in a direction opposite the direction of urging of said shuttle spring;

wherein, when the balls are engaged with said second sleeve interior groove, the second sleeve is fixed relative to the first sleeve and relative to the housing; and, wherein, when the shuttle second smaller end is in proximity to said circumferential holes of the second sleeve, the balls may move inwardly to disengage from said second sleeve interior circumferential groove, thus enabling said main spring to move the second sleeve and thereby said plunger.

2. The actuator of claim 1 wherein a first sleeve and shuttle are made of magnetic material; and, wherein the second sleeve is made of non-magnetic material.

3. The apparatus of claim 1 wherein said plunger extends lengthwise from said second end of the housing, to thereby act as a push rod when the plunger is moved by action of the main spring.

4. The apparatus of claim 1 wherein the shuttle has a hollow interior and said plunger extends lengthwise through the interior of said shuttle cavity and to the first end of the housing, to thereby act as a pull rod, for drawing an object toward the actuator first end under action of the main spring.

5. An electromechanical actuator of the type which has a housing having a lengthwise axis and a bore with a first end and a second end spaced apart along the axis;

a first element, for imparting linear force to an object external to the housing;

a first sleeve, extending lengthwise toward the second end of the housing, the outside diameter of the sleeve spaced apart from the bore of the housing, the sleeve having a plurality of circumferentially spaced apart holes for receiving balls;

a second sleeve, mounted on the exterior of the first sleeve and slidable therealong, in contact with or integral with said first element, the sleeve having an interior circumferential groove for engaging portions of one or more balls positioned in the holes of the first sleeve;

a pluarlity of balls positioned within said plurality of holes of said first sleeve, the balls adapted to move radially inward and outward within said holes;

wherein, when the balls are engaged with said second sleeve interior groove, the second sleeve is fixed relative to the first sleeve;

the improvement which comprises:

a main spring positioned within the interior of said second sleeve, for creating separation force between the first and second sleeves;

a shuttle, slidable within the interior of the second sleeve, made of magnetic material and having a stepped cylinder shape comprised of a first end corresponding with said first housing end and a second end corresponding with said housing second end; wherein said first end has a larger diameter than said second end; wherein when said first end of the shuttle slides into proximity of said plurality of balls positioned in holes of the first sleeve, said balls are contacted by the first end and thrust outwardly, to thereby engage said circumferential groove of the second sleeve; the shuttle further having a lengthwise bore cavity at the first end, for receiving a shuttle spring;

a shuttle spring, positioned within said cavity of the shuttle, for urging the shuttle lengthwise sufficiently to cause said shuttle second end to contact and thrust outwardly said balls; and, an electromagnetic coil for imparting lengthwise motion to the shuttle in a direction opposite the direction of urging of said shuttle spring.

6. In an electromechanical actuator of the type which comprises at least two sleeves which are slidable lengthwise relative to each other, wherein a multiplicity of balls are positioned within and radially movable within a plurality of holes in one of the sleeves, wherein motion of at least one sleeve relative to the another sleeve or to another part of the actuator is a function of whether or not the balls have a particular radial position, the improvement which comprises:

a first sleeve;

a second sleeve, the bore of which circumscribes the first sleeve;

a main spring positioned within the interior of said second sleeve, for creating separation force between the first and second sleeves;

a housing, for containing the first and second sleeves, wherein, the first sleeve is fixedly positioned relative to the housing, and wherein said separation force urges the second sleeve lengthwise relative to the housing;

a shuttle, slidable within the interior of the second sleeve, for urging the balls to move radially when sliding from one position to another position, having a lengthwise bore cavity at the first end, for receiving a shuttle spring;

a shuttle spring, positioned within said cavity of the shuttle, for urging shuttle lengthwise motion sufficient to cause radial motion of said balls in the absence of another moving force on the shuttle, and, an electromagnetic coil for imparting lengthwise motion to the shuttle in a direction opposite the direction in which said shuttle spring urges the shuttle.

7. The apparatus of claim 6 wherein said shuttle is magnetic; wherein a portion of said shuttle is contained within said electromagnetic coil; and wherein said lengthwise motion of the shuttle is imparted by electromagnetic force on the shuttle.

8. The apparatus of claim 6 wherein motion of the first sleeve is guided by sliding contact thereof with both the outside of the second sleeve and the interior of the housing.

9. The apparatus of claim 6 further comprising: a push or pull rod which slidably extends lengthwise from the housing, wherein the rod is connected to the second sleeve and is moved by action of the second sleeve.

10. The apparatus of claim 6 wherein when said balls are in radially outwardmost position, said first and second sleeves are locked together, to resist the force of said main spring.

11. In an electromechanical actuator of the type which comprises at least two sleeves which are slidable lengthwise relative to each other, wherein a multiplicity of balls are positioned within and radially movable within holes in one of the sleeves, wherein motion of at least one sleeve relative the another sleeve or to another part of the actuator is a function of whether or not the balls having a particular radial position, the improvement which comprises:

a first sleeve;

a second sleeve, the bore of which circumscribes the first sleeve;

a main spring, for creating separation force between the first and second sleeves;

a housing, for containing the first and second sleeves, wherein, the first sleeve is fixedly positioned relative to the housing, and wherein said separation force urges the second sleeve lengthwise relative to the housing;

a shuttle, slidable within the interior of the second sleeve, for urging the balls to move radially when sliding from one position to another position; and, means for imparting lengthwise motion to the shuttle.

12. The apparatus of claim 11 wherein motion of the first sleeve is guided by sliding contact thereof with both the outside of the second sleeve and the interior of the housing.

13. The apparatus of claim 12 wherein the main spring is positioned within the interior of said second sleeve.

14. The apparatus of claim 11 wherein said means for imparting lengthwise motion to the shuttle is an electromagnetic coil for urging the shuttle to move lengthwise.

15. The apparatus of claim 14 further comprising a shuttle spring, for urging lengthwise motion of the shuttle sufficient to cause radial motion of said balls in the absence of another moving force on the shuttle.

16. The apparatus of claim 11 further comprising a shuttle spring, for imparting lengthwise motion to the shuttle in a direction opposite the direction in which said means for imparting urges motion of the shuttle.

17. The apparatus of claim 16 wherein the shuttle has a lengthwise bore cavity at one end and wherein the shuttle spring is positioned within said cavity.

* * * * *